US008671668B2

(12) United States Patent
Gonze et al.

(10) Patent No.: US 8,671,668 B2
(45) Date of Patent: Mar. 18, 2014

(54) GENERATOR POWERED ELECTRICALLY HEATED DIESEL PARTICULATE FILTER

(75) Inventors: Eugene V. Gonze, Pinckney, MI (US); Michael J. Paratore, Jr., Howell, MI (US)

(73) Assignee: GM Global Technology Operations LLC

( * ) Notice: Subject to any disclaimer, the term of this patent is extended or adjusted under 35 U.S.C. 154(b) by 1403 days.

(21) Appl. No.: 12/016,456

(22) Filed: Jan. 18, 2008

(65) Prior Publication Data

US 2013/0313243 A1 Nov. 28, 2013

Related U.S. Application Data

(60) Provisional application No. 60/955,213, filed on Aug. 10, 2007.

(51) Int. Cl.

| | |
|---|---|
| ***F02D 3/00*** | (2006.01) |
| ***B01D 45/00*** | (2006.01) |
| ***B01D 45/18*** | (2006.01) |
| ***B01D 39/06*** | (2006.01) |
| ***B01D 46/00*** | (2006.01) |

(52) U.S. Cl.
USPC ..... 60/295; 60/297; 55/282.3; 55/428.1; 55/523; 95/283

(58) Field of Classification Search
USPC ..... 60/297, 295; 55/282.3, 523, 428.1; 95/283
See application file for complete search history.

(56) References Cited

U.S. PATENT DOCUMENTS

| | | | | |
|---|---|---|---|---|
| 3,065,357 | A * | 11/1962 | McMillan | 307/404 |
| 4,505,107 | A | 3/1985 | Yamaguchi et al. | |
| 4,505,726 | A | 3/1985 | Takeuchi | |
| 4,516,993 | A | 5/1985 | Takeuchi | |
| 4,535,589 | A | 8/1985 | Yoshida et al. | |
| 4,671,058 | A | 6/1987 | Yoshida et al. | |
| 5,277,937 | A | 1/1994 | Bagley et al. | |
| 5,423,904 | A | 6/1995 | Dasgupta | |
| 5,595,580 | A | 1/1997 | Kawamura | |
| 5,598,580 | A | 1/1997 | Detschel et al. | |
| 5,966,931 | A * | 10/1999 | Yoshizaki et al. | 60/284 |
| 6,052,988 | A * | 4/2000 | Ikeda | 60/284 |
| 6,120,583 | A | 9/2000 | Saito et al. | |
| 6,176,896 | B1 * | 1/2001 | Dementhon et al. | 95/14 |

(Continued)

FOREIGN PATENT DOCUMENTS

| | | | |
|---|---|---|---|
| DE | 4422198 | A1 | 1/1996 |
| DE | 69625866 | T2 | 6/2003 |
| DE | 60303250 | T2 | 7/2006 |
| DE | 102007014392 | | 10/2007 |
| EP | 0763650 | A1 | 3/1997 |
| EP | 1426592 | A2 | 6/2004 |
| JP | 09-166018 | | 6/1997 |

OTHER PUBLICATIONS

U.S. Appl. No. 11/561,100, filed Nov. 17, 2006, Eugene V. Gonze et al.

*Primary Examiner* — Thomas Denion
*Assistant Examiner* — Brandon Lee

(57) ABSTRACT

A control circuit for a vehicle powertrain includes a switch that selectivity interrupts current flow between a first terminal and a second terminal. A first power source provides power to the first terminal and a second power source provides power to the second terminal and to a heater of a heated diesel particulate filter (DPF). The switch is opened during a DPF regeneration cycle to prevent the first power source from being loaded by the heater while the heater is energized.

18 Claims, 1 Drawing Sheet

(56) References Cited

U.S. PATENT DOCUMENTS

| | | | | |
|---|---|---|---|---|
| 6,660,068 | B1 | 12/2003 | Garner et al. | |
| 6,736,870 | B2 | 5/2004 | Best et al. | |
| 7,469,532 | B2 | 12/2008 | Williamson | |
| 2004/0128985 | A1* | 7/2004 | Shimasaki et al. | 60/286 |
| 2005/0268596 | A1* | 12/2005 | Abe | 60/277 |
| 2007/0220870 | A1 | 9/2007 | Gonze et al. | |
| 2008/0104948 | A1* | 5/2008 | Kapparos et al. | 60/297 |

* cited by examiner

GENERATOR POWERED ELECTRICALLY HEATED DIESEL PARTICULATE FILTER

CROSS-REFERENCE TO RELATED APPLICATIONS

This application claims the benefit of U.S. Provisional Application No. 60/955,213, filed on Aug. 10, 2007. The disclosure of the above application is incorporated herein by reference.

STATEMENT OF GOVERNMENT RIGHTS

This invention was produced pursuant to U.S. Government Contract No. DE-FC-04-03 AL67635 with the Department of Energy (DoE). The U.S. Government has certain rights in this invention.

FIELD

The present disclosure relates to power control circuits for electrically heated diesel particulate filters.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrically heated diesel particulate filter (DPF) filters particulates or soot from the exhaust stream of a diesel internal combustion engine. When the DPF is full of soot it is regenerated by passing an electrical current through a heating element that is proximate to the DPF. The heater heats a portion the accumulated soot to its combustion temperature. The heated soot ignites, turns to gas, and passes through the DPF, thereby clearing it for another filtering cycle. The soot that is ignited by the heater also begins a flame or ember front that propagates through the remaining soot to also clear it from the DPF during the regeneration cycle.

An electrical system of the vehicle provides power for the heater. Since the exhaust gas carries heat away from the heater and reduces its temperature, the amount of power necessary to ignite the soot is based in part on the exhaust flow rate through the DPF. At high exhaust flow rates the power from the electrical system may be insufficient to heat the heater to a temperature that will ignite the soot during the regeneration cycle.

SUMMARY

A control circuit for a vehicle powertrain includes a switch that selectivity interrupts current flow between a first terminal and a second terminal. A first power source provides power to the first terminal and a second power source provides power to the second terminal and to a heater of a heated diesel particulate filter (DPF). The switch is opened during a DPF regeneration cycle to prevent the first power source from being loaded by the heater while the heater is energized.

In some features the first power source is a battery. The second power source is a generator. The switch is a relay switch. The control circuit further includes a powertrain control module that estimates a quantity of soot in the DPF and that opens the relay switch after the estimated quantity exceeds a predetermined quantity. The control circuit also includes a plurality of switches that selectively communicate the power from the second power source to respective heater zones of the heater. The switches are transistor switches. A current sense circuit generates a first signal indicative of an amount of current flowing to the heater. The current sense circuit includes a sense resistor in series with the current and an amplifier that generates the first signal based on a voltage drop across the sense resistor. An amplifier generates a second signal based on a voltage of the second power source.

A control circuit for a vehicle powertrain includes a first switch that selectivity interrupts current flow between a first terminal and a second terminal, a battery that provides power to the first terminal, a generator that provides power to the second terminal and to a heater of a heated diesel particulate filter (DPF), a second switch that selectively communicates the power from the second power source to the heater, and a powertrain control module that controls the first and second switches and that estimates a quantity of soot in the DPF. The powertrain control module opens the first switch and closes the second switch after the estimated quantity of soot exceeds a predetermined quantity of soot, thereby powering the heater with the generator and preventing the heater from loading the battery.

In other features the first switch is a relay. The heated DPF includes a plurality of resistive heaters and the second switch comprises a plurality of transistor switches that selectively communicate the power from the second power source to a respective one of the resistive heaters. A current sense circuit generates a first signal indicative of an amount of current flowing to the heater. The current sense circuit includes a sense resistor in series with the current and an amplifier that generates the first signal based on a voltage drop across the sense resistor. An amplifier generates a second signal based on a voltage of the second power source.

A method of providing power to a heater of a heated diesel particulate filter (DPF) includes electrically connecting first and second power sources to each other, deciding to energize the heater, electrically disconnecting the first and second power sources from each other, and powering the heater from the second power source.

In other features the method includes diagnosing the heater based on monitoring at least one of a voltage and current to the heater. The heater includes a plurality of heater zones and the powering step includes sequencing the power to each of the heater zones individually. The method includes managing at least one load that is powered by the first power source during the powering step. The method includes increasing an output voltage of the second power source while the first and second power sources are electrically disconnected.

In still other features, the systems and methods described above are implemented by a computer program executed by one or more processors. The computer program can reside on a computer readable medium such as but not limited to memory, non-volatile data storage and/or other suitable tangible storage mediums.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
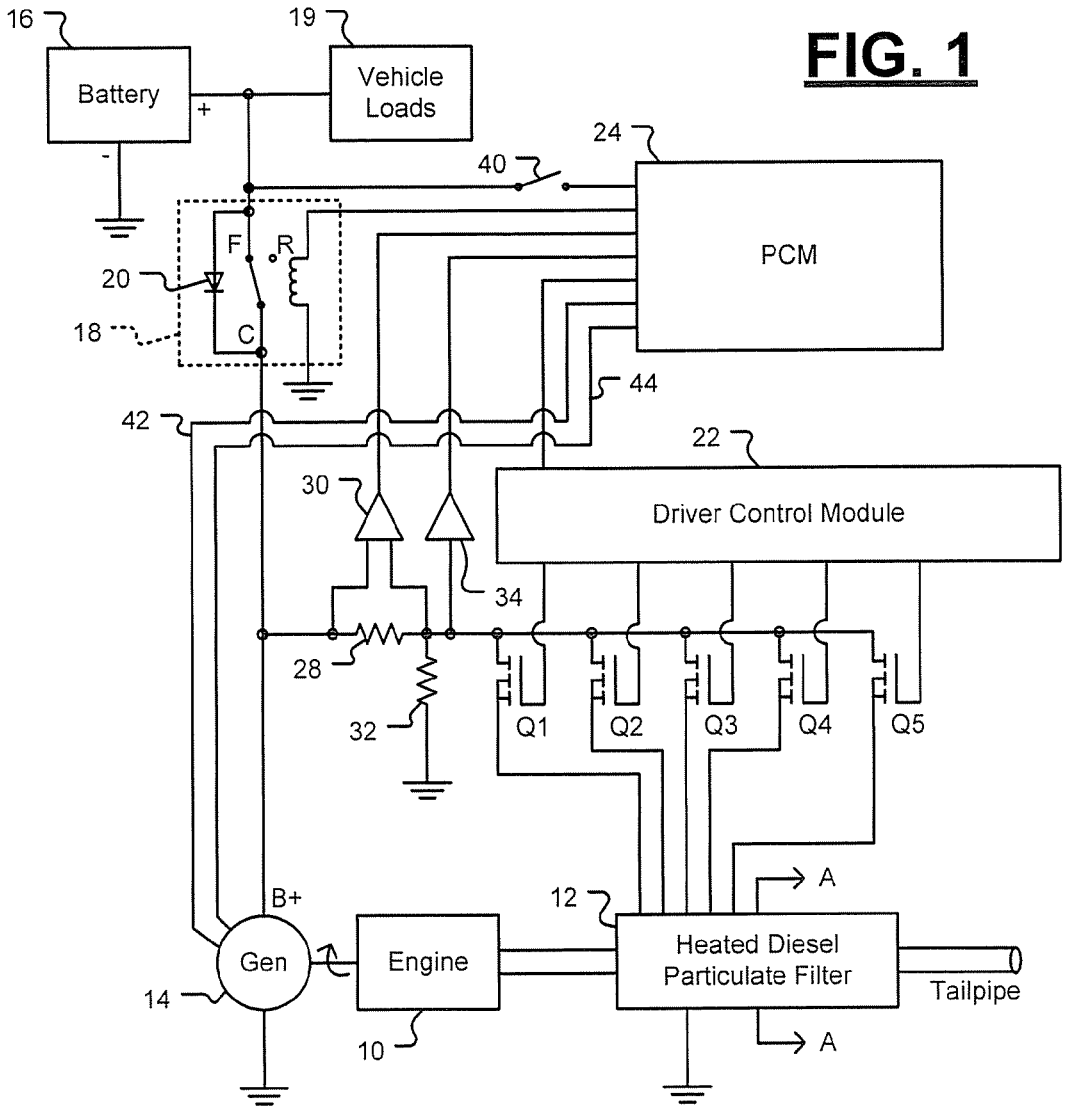
FIG. 1 is a functional block diagram of a heater control circuit for a heated DPF.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a functional block diagram is shown of a vehicle powertrain that includes a diesel engine 10, a heated diesel particulate filter (DPF) 12, and control circuitry that provides power to one or more heaters of heated DPF 12. Exhaust from diesel engine 10 includes soot or particulate matter that heated DPF 12 traps. From time to time the control circuitry energizes heated DPF 12 to burn off the trapped soot and thereby empty or regenerate heated DPF 12. While the control circuitry energizes heated DPF 12 it also opens a relay 18. When relay 18 is open it electrically isolates the power (B+) from a generator 14 from the power from a battery 16. It should be appreciated that generator 14 may also be implemented with an alternator and rectifier as is known in the art.

During the regeneration cycle the control circuitry powers heated DPF 12 exclusively from generator 14 and powers other vehicle loads 19 exclusively from battery 16. The control circuitry thereby prevents the electrical load presented by heated DPF 12 from reducing the voltage available to other vehicle loads 19. As a result, vehicle loads 19 receive adequate power during the regeneration cycle and are free of undesirable effects such as drooping fan speeds, dimming headlamps, and other such effects while heated DPF 12 is energized. In some embodiments the vehicle loads 19 can be load managed by a control module to prevent them from reducing the output voltage of battery 16 to less than a predetermined voltage. The load management may also be as simple as inhibiting significant loads, such as a highest climate control fan speed, a heated back light, and the like, while relay 18 is open. Opening relay 18 also allows the output voltage of generator 14 to be regulated at a higher voltage than the voltage of battery 16 without damaging vehicle loads 19. While generator 14 is operating with an increased output voltage it can generate more power than when its output voltage is regulated to the voltage of battery 16. The increased power improves the heat output of the heater when compared to the heat output of the heater when it operates at the voltage of battery 16.

Figure 2:
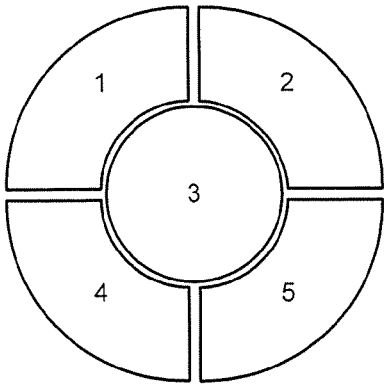
FIG. 2 is a cross-sectional view of heater zones of the heated DPF of FIG. 1.

The control circuitry will now be described in more detail. Heated DPF 12 can include one or more zones or regions that may be individually energized and heated. For example, each zone may be formed by an associated resistive heating element. Referring briefly to FIG. 2, a cross section view A-A of heated DPF 12 shows five heater zones. The five zones are identified by numerals 1-5. Zones 1, 2, 4 and 5 each have a quarter-semicircle shape and are arranged to form a circle. Zone 3 has a circular shape and is positioned at the center of the circle formed by zones 1, 2, 4 and 5. It should be appreciated that a different quantity and/or arrangement of zones may be used based on the cross-sectional area of heated DPF 12, power available from the control circuit, anticipated exhaust flow rates through heated DPF 12, and other factors that affect the ability of the heater to ignite soot in heated DPF 12.

Each zone is energized exclusive of the other zones. The energized zone heats a portion of the accumulated soot to its combustion temperature. Once the soot ignites then the zone can be turned off. The ignited soot propagates a flame or ember front through the remaining soot to regenerate a respective portion of the filter. The zone is turned on for less than the duration of the regeneration cycle of the respective zone. Since a portion of the regeneration is fueled by the burning soot itself, the zone-heated DPF can use less electrical energy and provide improved fuel economy over other types of heated DPFs 12. An example of a zone-heated DPF 12 is described in U.S. patent application Ser. No. 11/561,100, which is hereby incorporated by reference in its entirety.

Returning now to FIG. 1, a positive terminal of battery 16 communicates with vehicle loads 19. Examples of vehicle loads 19 include headlamps, fan motors, and the like. The positive terminal of battery 16 also communicates with a first terminal F of a relay 18. A common terminal C of relay 18 communicates with an output of generator 14. Relay 18 may be implemented with an electromechanical relay, a solid state relay, a transistor switch, or other suitable switching device. A diode 20 may be connected across the contacts of relay 18 to bias a field of generator 14 even when relay 18 is open.

The output of generator 14 also provides power to drains of transistors Q1-Q5. Sources of transistors Q1-Q5 selectively provide power to respective heater zones 1-5 of heated DPF 12 (shown in FIG. 2). Gates of transistors Q1-Q5 are driven by respective outputs of a driver control module 22. Driver control module 22 turns on one or more transistors Q1-Q5 to turn on respective ones of the heater zones. Driver control module 22 communicates with a powertrain control module (PCM) 24 to determine which of transistors Q1-Q5 to turn on. In some embodiments the transistors Q1-Q5 are turned on sequentially and one at a time so that each corresponding heater zone receives the full power from generator 14 for a limited time.

In some embodiments the current to drains of transistors Q1-Q5 may pass through a sense resistor 28. An amplifier 30 amplifies the signal across sense resistor 28. The amplified signal is communicated to PCM 24 and represents the amount of current that is flowing to transistors Q1-Q5 and consequently to the heater of heated DPF 12. A resistor 32 can be used to present some minimum load to the output of generator 14. The minimum load prevents the output voltage of generator 14 from becoming excessive and potentially damaging transistors Q1-Q5. An amplifier 34 may be employed to amplify or buffer the voltage applied to the drains of transistors Q1-Q5. The signal from amplifier 34 is communicated to PCM 24 and represents the amount of voltage that is applied to transistors Q1-Q5 and consequently the activated heater zone(s) of heated DPF 12. PCM 24 can employ the signals from amplifiers 30 and/or 34 to diagnose transistors Q1-Q5 and/or their corresponding heater zones. PCM 24 estimates a quantity of soot in heated DPF 12. When the estimated quantity of soot exceeds a predetermined quantity of soot then PCM 24 opens relay 18, commands for one of transistors Q1-Q5 to be turned on, and increases the output voltage of generator 14.

PCM 24 may receive power from battery 16 via an ignition switch 40. PCM 24 may also receive power directly from battery 16. In such a configuration, PCM 24 can receive the signal from ignition switch 40 to indicate that engine 10 may be running.

PCM 24 can also communicate a generator field signal 42 to generator 14. PCM 24 can vary a duty cycle of generator field signal 42 to control the output voltage of power of generator 14. PCM 24 can also receive a generator field diagnostic signal 44 that indicates whether the generator field is turned on or off at any moment. PCM 24 can then diagnose the generator field based on the generator field signal 42 and the generator field diagnostic signal 44.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control circuit for a vehicle powertrain, comprising:

a first power source that provides power to a vehicle load;

a second power source that selectively provides power to a heater of a heated diesel particulate filter (DPF); and a switch having a first position and a second position, wherein when the switch is in the first position, the second power source is electrically connected to the first power source and the second power source is electrically connected to the heater of the DPF, and when the switch is in the second position, (i) the second power source is electrically connected to the heater, (ii) the second power source is electrically disconnected from the first power source to prevent the first power source from being loaded by the heater while the heater is energized, and (iii) the power provided by the first power source to the vehicle load is limited to maintain an output voltage of the first power source above a predetermined voltage.

2. The control circuit of claim 1 wherein the first power source comprises a battery.

3. The control circuit of claim 1 wherein the second power source comprises a generator.

4. The control circuit of claim 1 wherein the switch comprises a relay switch.

5. The control circuit of claim 4 further comprising a powertrain control circuit that estimates a quantity of soot in the DPF and that opens the relay switch after the estimated quantity exceeds a predetermined quantity.

6. The control circuit of claim 1 further comprising a plurality of switches that selectively communicate the power from the second power source to respective heater zones of the heater.

7. The control circuit of claim 6 wherein the switches comprise transistor switches.

8. The control circuit of claim 1 further comprising a current sense circuit that generates a first signal indicative of an amount of current flowing to the heater.

9. The control circuit of claim 8 wherein the current sense circuit includes a sense resistor in series with the current and an amplifier that generates the first signal based on a voltage drop across the sense resistor.

10. The control circuit of claim 1 further comprising an amplifier that generates a second signal based on a voltage of the second power source.

11. The control circuit of claim 1 wherein the first position of the switch comprises a closed position and the second position of the switch comprises an open position.

12. The control circuit of claim 1 wherein the power provided by the first power source to the vehicle load is limited by lowering a speed of a climate control fan when the switch is in the second position.

13. The control circuit of claim 1 wherein the power provided by the first power source to the vehicle load is limited by turning off a heated back light when the switch is in the second position.

14. A method of providing power to a heater that provides heat to a diesel particulate filter (DPF), the method comprising:

electrically connecting a first power source to a second power source;

electrically connecting the second power source to the heater while the first power source and the second power source are electrically connected;

electrically disconnecting the first power source from the second power source to prevent the first power source from being loaded by the heater when the heater is energized;

powering the heater from the second power source; and limiting power to at least one vehicle load that is powered by the first power source when the first power source is electrically disconnected from the second power source to maintain an output voltage of the first power source above a predetermined voltage.

15. The method of claim 14 further comprising diagnosing the heater based on monitoring at least one of a voltage and current to the heater.

16. The method of claim 14 wherein the heater includes a plurality of heater zones and the powering step includes sequencing the power to each of the heater zones individually.

17. The method of claim 14 further comprising increasing an output voltage of the second power source while the first and second power sources are electrically disconnected.

18. The method of claim 14 wherein the limiting comprises lowering a speed of a climate control fan.

* * * * *